US006779658B2

(12) United States Patent
Polloni et al.

(10) Patent No.: US 6,779,658 B2
(45) Date of Patent: Aug. 24, 2004

(54) RIGID PACK WITH A HINGED LID

(75) Inventors: Roberto Polloni, Modigliana (IT); Chiara Colo', Fiumalbo (IT); Igino Conti, Bologna (IT); Fiorenzo Draghetti, Medicina (IT)

(73) Assignee: G.D. S.p.A., Bologna (IT)

( * ) Notice: Subject to any disclaimer, the term of this patent is extended or adjusted under 35 U.S.C. 154(b) by 98 days.

(21) Appl. No.: 10/149,379

(22) PCT Filed: Dec. 5, 2000

(86) PCT No.: PCT/IB00/01796

§ 371 (c)(1),
(2), (4) Date: Jun. 12, 2002

(87) PCT Pub. No.: WO01/44077

PCT Pub. Date: Jun. 21, 2001

(65) Prior Publication Data

US 2002/0190110 A1 Dec. 19, 2002

(30) Foreign Application Priority Data

Dec. 15, 1999 (IT) ..... BO99A000681

(51) Int. Cl.[7] ..... B65D 85/10

(52) U.S. Cl. ..... 206/268; 206/265; 206/271; 229/115

(58) Field of Search ..... D9/423, 430, 504; 206/85–95, 236, 242, 259, 265, 268, 271, 273, 822; 229/109, 115, 160.1

(56) References Cited

U.S. PATENT DOCUMENTS

| | | | | | |
|---|---|---|---|---|---|
| 580,080 | A | * | 4/1897 | Borlinghaus | 206/249 |
| D296,938 | S | * | 7/1988 | Ameringen | D9/423 |
| 5,375,713 | A | * | 12/1994 | Horvat et al. | 206/418 |
| 5,873,514 | A | * | 2/1999 | Brooks | 229/115 |

* cited by examiner

*Primary Examiner*—Jim Foster
(74) *Attorney, Agent, or Firm*—Davidson Berquist Klima & Jackson LLP

(57) ABSTRACT

A rigid pack (100) with a hinged lid (12) serves both as a carton proportioned to accommodate a plurality of packets (1) of cigarettes (3), and as a single packet (1); in either instance the pack comprises a container (10) surmounted by a lid (12) hinged to one open end (11) of the container and rotatable between positions in which the container (10) is open and closed, respectively. The pack (100) appears prismatic in shape and substantially triangular in section.

25 Claims, 14 Drawing Sheets

RIGID PACK WITH A HINGED LID

TECHNICAL FIELD

The present invention relates to a rigid pack with a hinged lid.

The term "pack" used throughout the following specification can be taken to mean either a carton proportioned to accommodate a plurality of packets of cigarettes, or a single packet containing a group of cigarettes or tobacco products broadly considered.

BACKGROUND ART

In general, rigid packs of the type in question with a hinged lid are of rectangular parallelepiped shape, appearing as a container surmounted by a lid hinged to an open top end of the selfsame container and rotatable thus between positions in which the container is open and closed.

In the case of a carton, more particularly, the relative container is designed to hold a plurality of packets of cigarettes, whereas in the case of a packet the container is designed to hold a group of cigarettes enveloped in an inner wrapper.

Both the container and the lid present a front and a rear face and two flank faces, and respective end faces coinciding with the bottom and the top of the pack.

The pack is furnished with an internal stiffening frame comprising a breast piece and two side pieces hinged to the breast piece, disposed partly inside the container with the breast piece anchored to a front panel that corresponds to the front face of the container, and with the side pieces anchored to two side panels corresponding to the flank faces of the container. The correct and stable retention of the lid when in the closed position is improved by incorporating a pair of tabs created from relative cuts made along the crease lines joining the side pieces and the breast piece, which project beyond the breast piece on either side in such a manner as to interfere internally with the flanks of the lid when closed.

A rigid pack of the type in question is fashioned typically from a flat diecut blank of substantially rectangular outline prepared with transverse crease lines positioned to create a first larger end panel coinciding with the front face of the container, a first smaller intermediate panel coinciding with the bottom, a second larger panel coinciding with the rear face of the container, a second smaller intermediate panel coinciding with the rear face of the lid, also a further smaller intermediate panel coinciding with the top, a third larger panel that coincides with the front face of the lid, and an end panel serving to stiffen the lid.

The blank also presents longitudinal crease lines along which respective pairs of flaps are hinged to the aforementioned panels in such a way that when the blank is folded and the packet erected, these same flaps combine to form the flank faces and the reinforcing folds for the end faces.

The transverse dimensions of the panels affording the front and rear faces both of the container and of the lid tend to predominate over the transverse dimensions of the flaps making up the flank faces, so that the pack presents a flattish parallelepiped geometry.

One of the drawbacks encountered with packets of flat parallelepiped shape typified by a rectangular cross section in which one dimension predominates appreciably over the other, is that the progressive removal of the cigarettes from the packet has the effect of causing those left inside to acquire a notable freedom of movement in the predominating transverse dimension, so that the group tends to break up, the cigarettes knock against one another and a considerable quantity of tobacco filler is lost from the tips.

Another drawback deriving directly from the flat parallelepiped shape of the packet is that the cigarettes remaining in the packet tend naturally to topple sideways, lying skew in relation to the longitudinal axis of the packet and substantially parallel to a diagonal of the front and rear faces, so that the correct position of the group when assembled in full number is lost. This drawback, in combination with the relatively small transverse dimension of the flank faces, makes it especially difficult for the smoker to capture the remaining cigarettes, with the result that the cigarettes can be damaged still further, bending and even breaking completely.

The object of the present invention is to provide a packet unaffected by the drawbacks described above.

A further object of the invention is to provide a carton such as will accommodate packets embodied in accordance with the present invention.

DISCLOSURE OF THE INVENTION

The stated object is realized according to the present invention in a rigid pack with a hinged lid, comprising a container, also a lid hinged to one open end of the container and rotatable thus between a position in which the container is open and a position in which the container is closed, characterized in that it appears prismatic in shape and substantially triangular in section.

The invention will now be described in detail, by way of example, with the aid of the accompanying drawings, in which.

Figure 18:
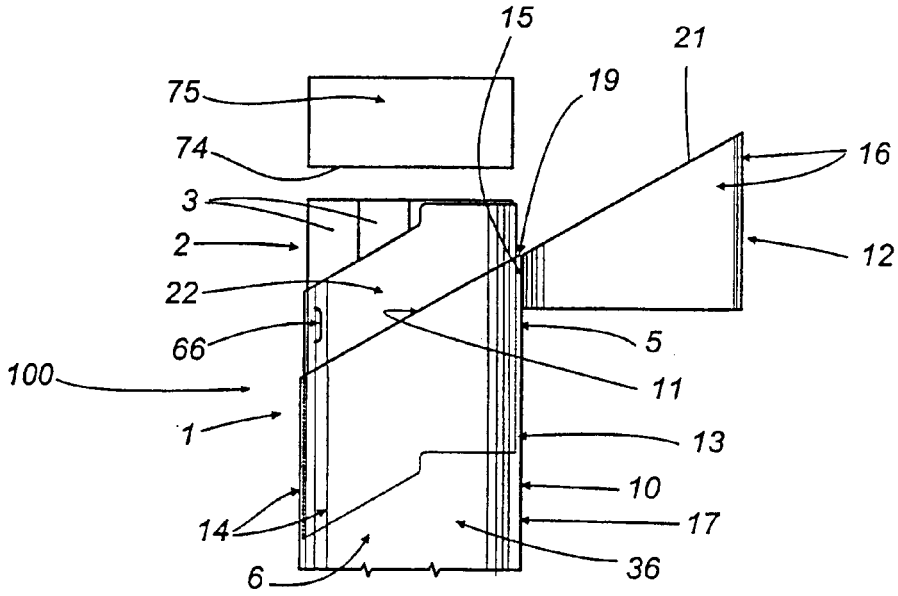
FIG. 18 is a schematic side elevation showing one of the packets as in FIGS. 1 to 4 with the lid open, and illustrating a portion of the inner wrapper with the end folds removed to afford access to the contents.
Figure 19:
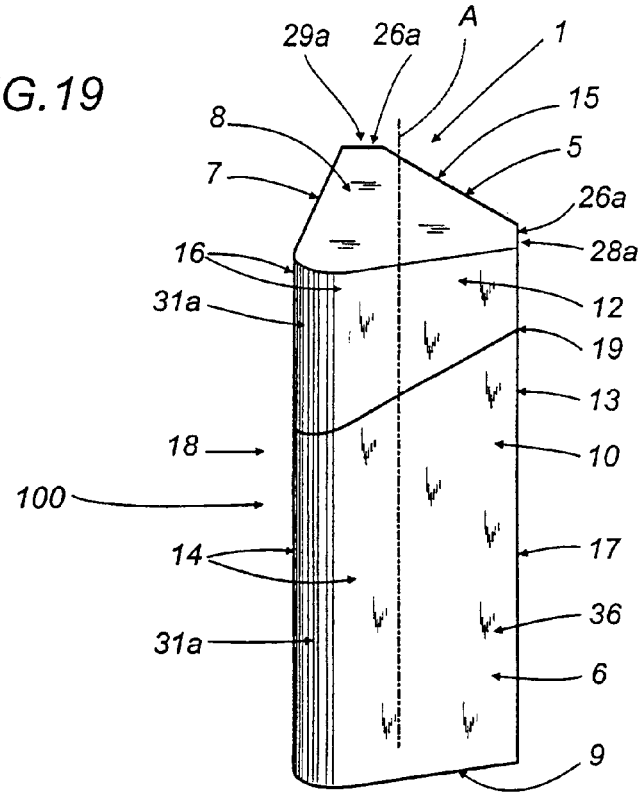
FIG. 19 illustrates a further embodiment of a packet according to the present invention, viewed schematically and in perspective.

With reference to FIGS. 1 to 4 and to FIG. 19 of the drawings, 100 denotes a rigid pack, in its entirety, and more particularly 1 denotes a rigid packet with a hinged lid, in its entirety, designed to contain a group 2 of cigarettes 3 visible in FIGS. 11, 12, 13 and 18. The group 2 is enveloped by an inner wrapper 4 made of a relative wrapping material and accommodated inside the packet 1, as shown to advantage in FIG. 14.

The single packet 1 comprises an outer wrapper 36 appearing as a prismatic solid of substantially triangular cross section, and thus presents three substantially rectangular side faces 5, 6 and 7, disposed contiguously and extending parallel to a predominating longitudinal axis A of the prism, and two substantially triangular end faces 8 and 9.

The packet 1 comprises a container 10 with an open top end 11, as illustrated in FIGS. 14, 15, 16, 17 and 18, and a lid 12 hinged to the selfsame container 10 in such a way as to rotate between an open position shown in FIGS. 12, 14, 15, 16, 17 and 18, in which the top end 11 is exposed, and a closed position shown in FIGS. 1, 2, 3, 4 and 19 in which the top end 11 is concealed.

The container 10 presents a rear wall denoted 13 coinciding with one side face 5 of the triangular prism, and a front wall denoted 14 coinciding with the remaining two side faces 6 and 7 of the prism. The lid 12 likewise, when in the closed position, presents a rear wall 15 coinciding with the one side face 5 of the prism and a front wall 16 that coincides with the two remaining side faces 6 and 7 of the prism.

In practice, the rear wall 13 of the container 10 and the rear wall 15 of the lid 12 together make up the back 17 of the single packet 1 whilst the front wall 14 of the container 10 and the front wall 16 of the lid 12 together make up the front 18 of the packet.

The lid 12 is attached to the container 10 along a hinge line 19 placed transversely to the back 17 of the packet, separating the rear wall 15 of the lid 12 from the rear wall 13 of the container 10.

The open top end 11 of the container 10 is circumscribed by a top edge 20 disposed obliquely in relation to the axis A of the prism and in such a way as to engage in contact with a corresponding oblique edge 21 afforded by the lid 12.

Lastly, the rigid packet 1 comprises a stiffening frame 22 projecting in part beyond the edge 20 of the open top end 11 afforded by the container 10, of which two faces 23 occupy substantially the same planes as the front faces 6 and 7 of the packet 1 and function as the breast piece 24 of the frame 22 in the finished packet.

The frame 22 is anchored to the inside surface of the front wall 14 of the container 10, in such a way as to provide a retaining element by which the lid 12 is held stably on the container 10 when in the closed position.

Figure 1:
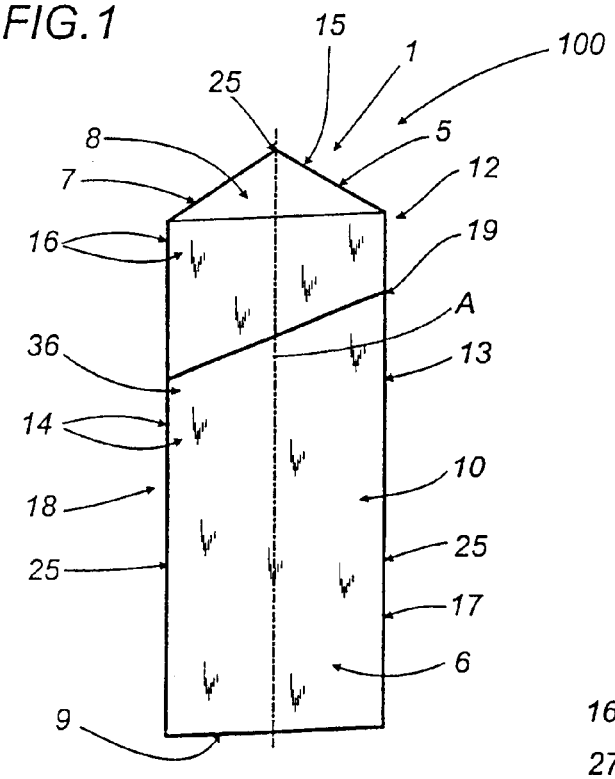
FIGS. 1, 2, 3 and 4 illustrate four embodiments of a packet according to the present invention, viewed schematically and in perspective.
Figure 2:
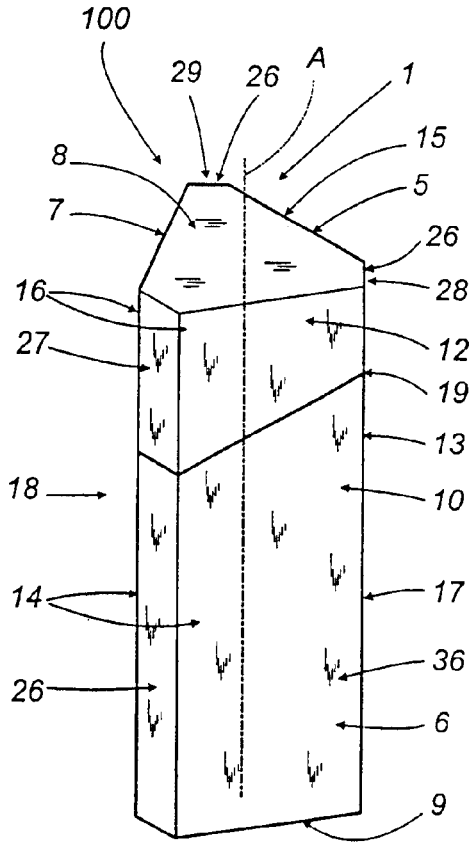

In the example of FIG. 1, the three faces 5, 6 and 7 of the rigid packet 1 are joined along sharp corner edges 25, whereas in the example of FIG. 2 the three faces 5, 6 and 7 of the packet 1 are joined along blunted corner edges 26 presenting three faces 27, 28 and 29 of which a first face 27 is interposed between the two faces 6 and 7 making up the front 18, a second face 28 is interposed between the faces denoted 5 and 6 and the third face 29 is interposed between the faces denoted 5 and 7.

Figure 3:
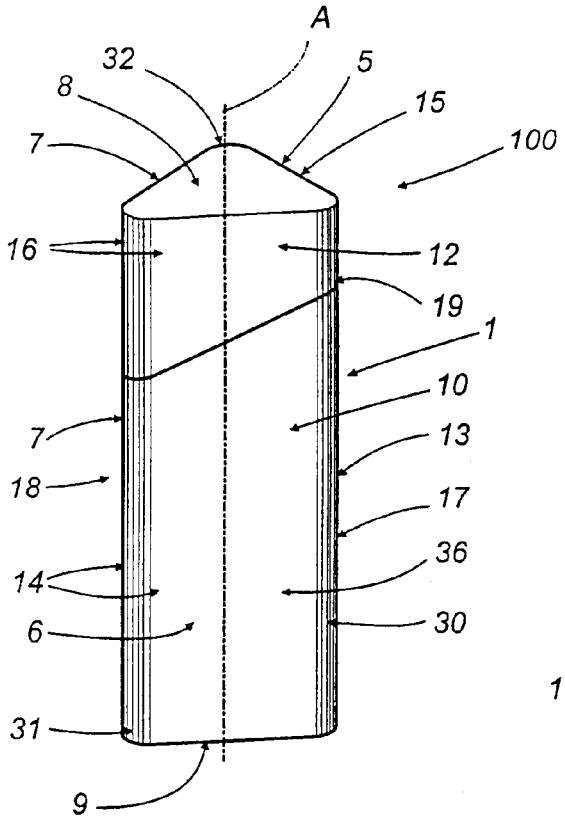
Figure 4:
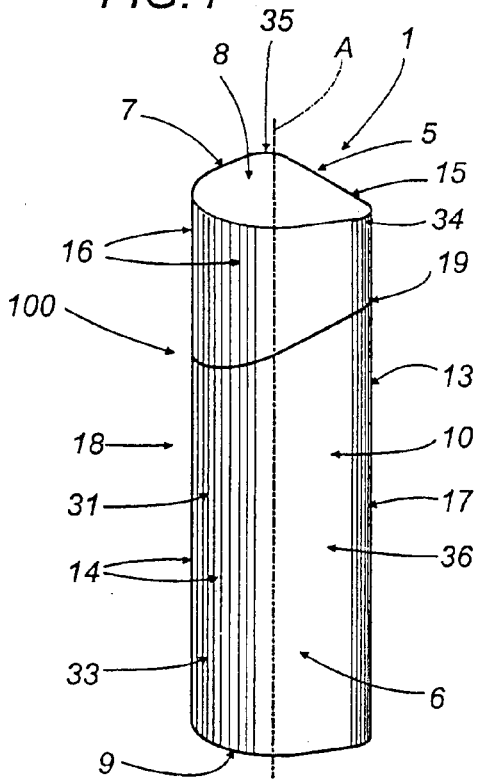
Figure 12:
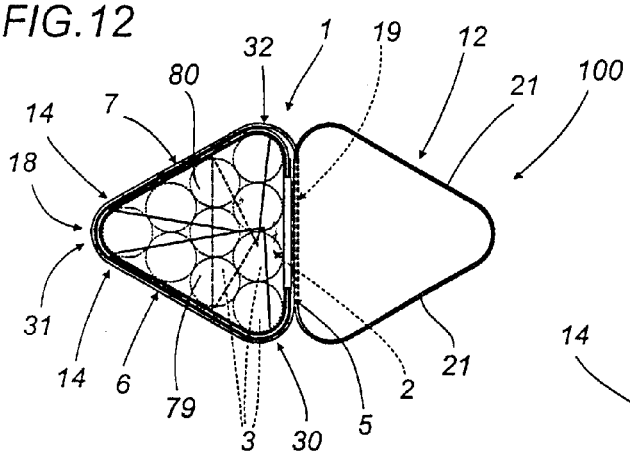
FIGS. 12 and 13 illustrate a packet respectively as in FIGS. 1, 2 and 3 and as in FIG. 4, seen schematically in plan from above and with the lid open.
Figure 13:
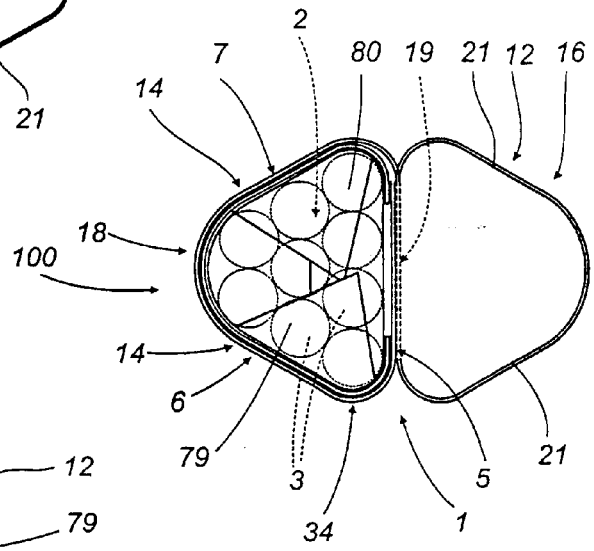

In the example of FIGS. 3 and 12, the three faces 5, 6 and 7 of the packet 1 are joined along three similar rounded corner edges 30, 31 and 32, whereas in the example of FIGS. 4 and 13 the three faces 5, 6 and 7 of the packet 1 are joined along three rounded corner edges 33, 34 and 35 with dissimilar radii of curvature; more exactly, two of the rounded edges 34 and 35 present an identical radius of curvature, whereas the rounded edge 33 interposed between the two front faces 6 and 7 presents a radius of curvature greater than that of the two remaining rounded corner edges 34 and 35.

In the example of FIG. 19 the two faces 6 and 7 making up the front 18 of the packet 1 are joined along a rounded corner edge 31*a*, whilst the back 13 of the packet 1 coinciding with the rear face 5 of the prism is joined to the two front faces 6 and 7 along two blunted corner edges 26*a* defining two faces 28*a* and 29*a*, of which the one face 28*a* is interposed between the faces denoted 5 and 6 and the other face 29*a* interposed between the faces denoted 5 and 7.

Figure 5:
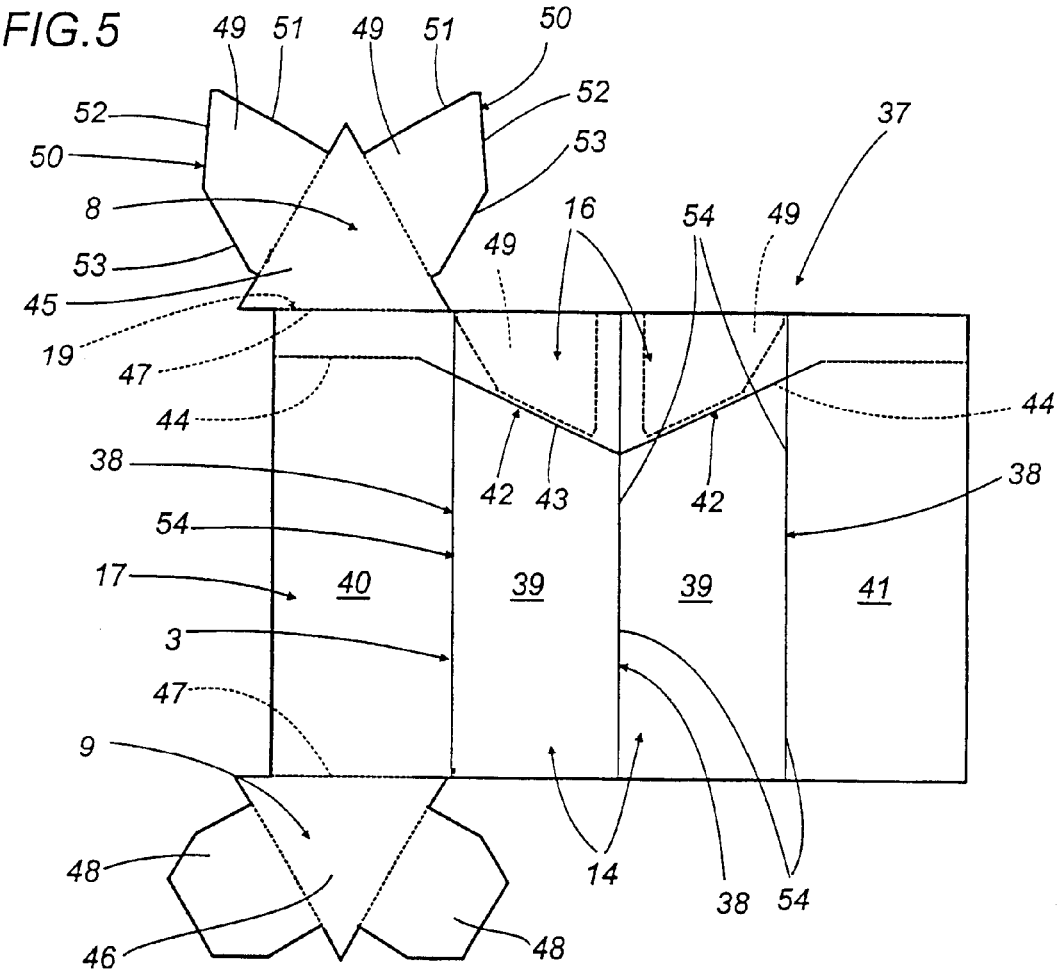
FIGS. 5 to 10 are plan views of diecut blanks from which to fashion the packets illustrated in FIGS. 1 to 4.
Figure 7:
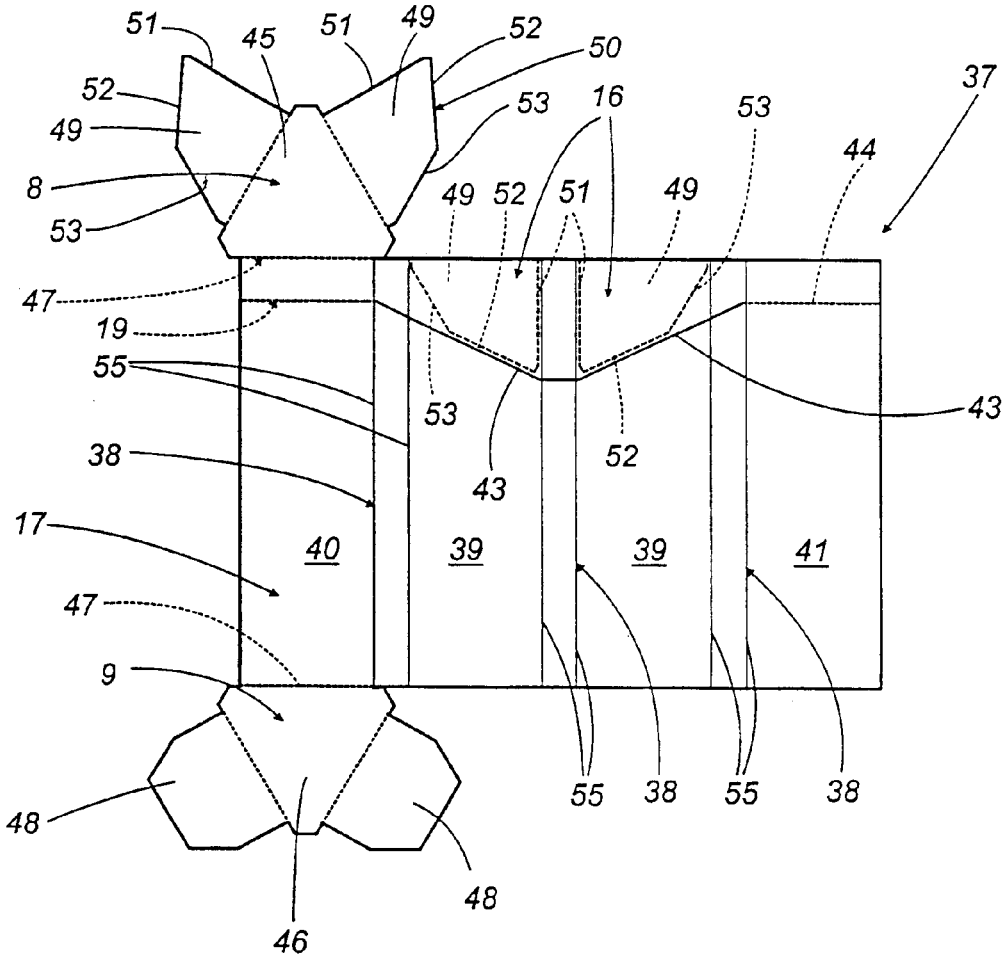
Figure 9:
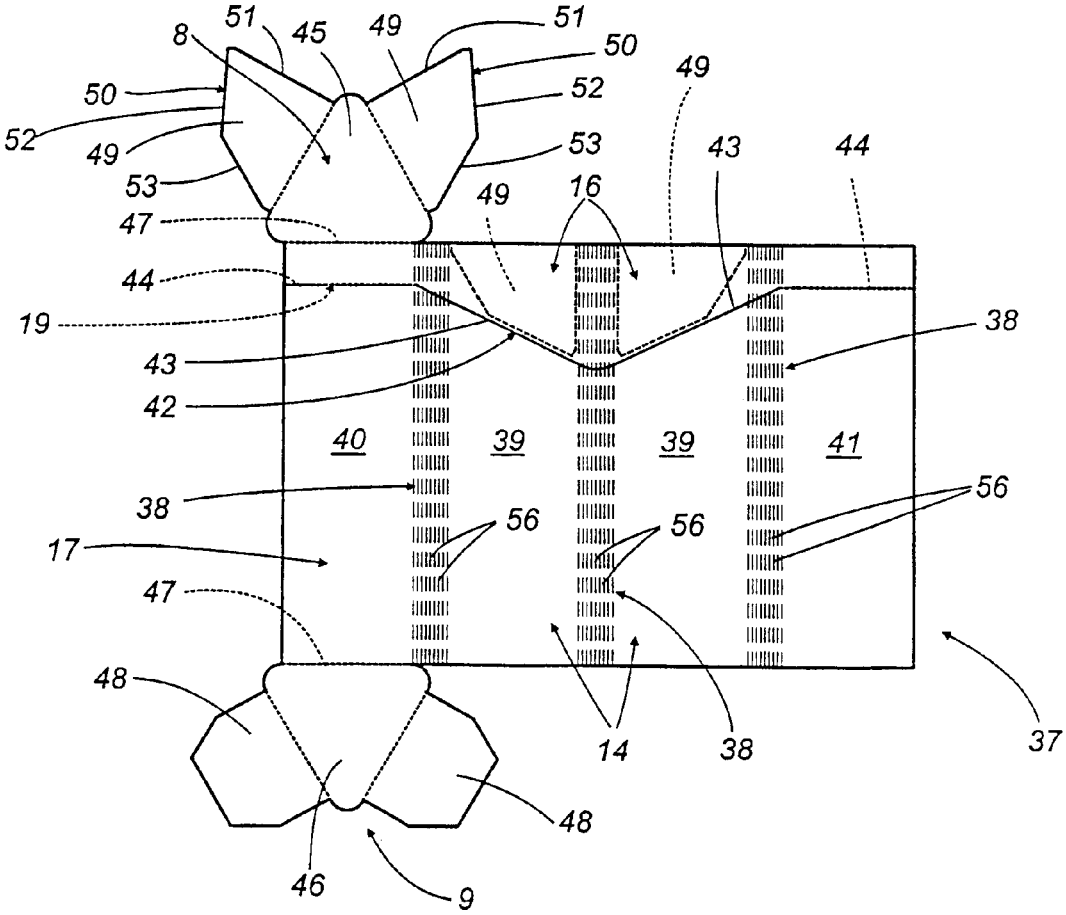

With reference to FIGS. 5, 7 and 9, the outer wrapper 36 of the packet 1 is fashioned from a flat diecut blank 37 of essentially rectangular outline presenting three mutually parallel precreased fold areas 38 positioned to separate two panels 39 which make up the front 18 of the packet 1, a panel 40 coinciding with the back 17 of the packet 1, and a further connecting panel 41 that will be breasted ultimately in contact with the inside surface of the back panel 40.

The blank 37 also presents a transverse Vee cut 42 intersecting the three precreased fold areas 38, and more exactly composed of two angled legs 43 converging onto the central precreased area 38, by which the front wall 14 of the container 10 on the one hand is separated from the front wall 16 of the lid 12 on the other. The two ends of the transverse Vee cut 42 are joined to respective crease lines 44 (indicated by phantom lines) extending transversely across the two corresponding panels 40 and 41 and functioning as the hinge 19 of the lid 12.

The panel 40 coinciding with the back 17 of the packet 1 is associated with a top wing 45 and a bottom wing 46, each joined to the panel 40 by way of a relative crease line 47. The two wings 45 and 46 coincide respectively with the top end face 8 or top and with the bottom end face 9 or bottom of the packet 1.

The two free sides of the bottom wing 46 carry two respective flaps 48 such as can be anchored to the inside surfaces of the panels 39 coinciding with the front wall 14 of the container 10, so that the bottom wing 46 will constitute the bottom 9 of the packet 1.

The two free sides of the top wing 45 carry two respective flaps 49 such as can be anchored to the inside surfaces of the panels 39 coinciding with the front wall 16 of the lid 12, so that the top wing 45 will constitute the top 8 of the packet 1.

The flaps 49 of the top wing 45 are proportioned peripherally such that when anchored to the inside surfaces of the front wall 16 of the lid 12, their free edges 50 will overlap neither the precreased fold areas 38 nor the Vee cut 42.

More exactly, the free edge 50 of each flap 49 comprises three legs 51, 52 and 53 of which the first two 51 and 52 extend parallel respectively to the central precreased area 38 and to the legs 43 of the Vee cut 42 once the packet 1 is erected.

Referring to the example of FIG. 5, in which the blank 37 is folded to produce a packet 1 as shown in FIG. 1, the precreased fold areas 38 consist in respective single crease lines 54 which generate sharp corner edges 25 in the finished packet 1. Accordingly, the vertices of the top flap 45 and the bottom flap 46 appear as acute angles.

Referring to the example of FIG. 7, in which the blank 37 is folded to produce a packet 1 as in FIG. 2, the precreased fold areas 38 consist each in two mutually parallel crease lines 55 spaced apart at a first selected distance. Accordingly, the vertices of the top and bottom flaps 45 and 46 appear truncated.

Referring to the example of FIG. 9, in which the blank 37 is folded to produce a packet 1 as in FIG. 3, the precreased fold areas 38 will consist each in a plurality of mutually parallel crease lines 56, and accordingly, the vertices of the top and bottom flaps 45 and 46 appear rounded.

In the case of the packet 1 shown in FIG. 4 the relative blank (not illustrated) differs from the blank 37 of FIG. 9 only in that the transverse dimension of the central precreased area 38 is greater than that of the two lateral areas 38, so that when the blank is erected to form a packet, the rounded corner edge denoted 33 will present a radius of curvature greater than that of the other two rounded corner edges 34 and 35, as discernible clearly in FIGS. 4 and 13.

In the case of the packet 1 shown in FIG. 19, the relative blank (not illustrated) differs from the blank 37 of FIG. 9 in that it presents a central precreased area 38 of the type designed to produce a rounded corner edge 31*a*, whilst the two remaining lateral precreased areas 38 consist each in a pair of two mutually parallel crease lines 55 set apart at a first selected distance similarly to the blank 37 illustrated in FIG. 7, which produce the aforementioned blunted corner edges 26*a*.

Figure 6:
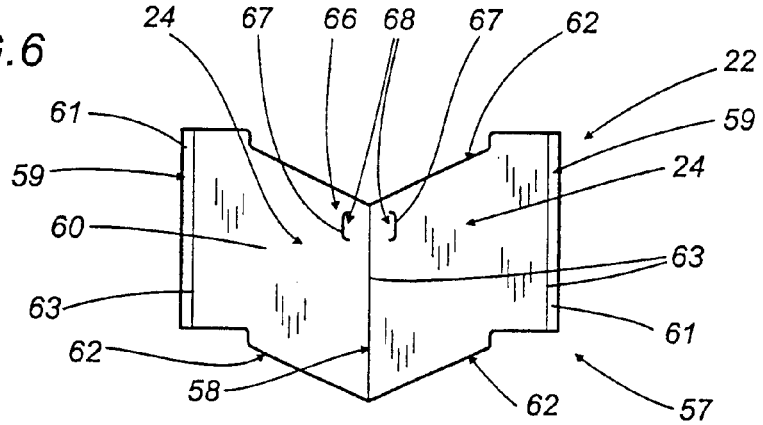
Figure 8:
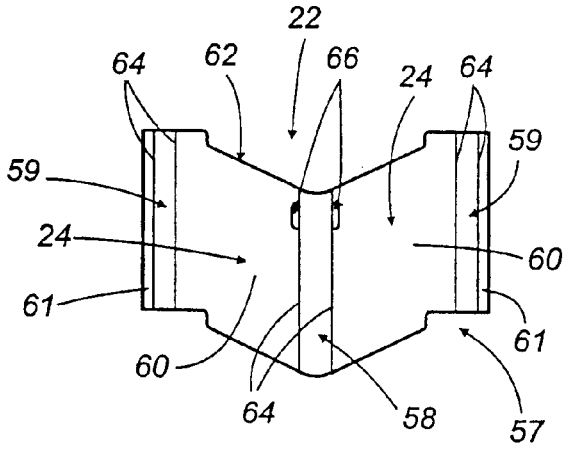
Figure 10:
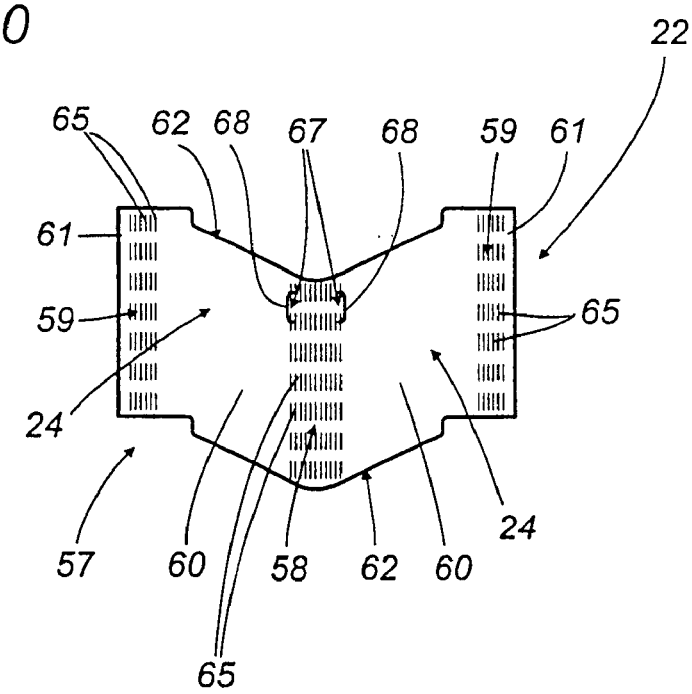

Referring to FIGS. 6, 8 and 10, the frame 22 is fashioned from a separate flat blank 57 of wrapping material exhibiting a central precreased area 58 and two lateral precreased areas 59 compassing two relative panels 60 that coincide with the breast piece 24 of the frame 22. In the erected packet 1, the two panels 60 are fixed to the inside surfaces of the panels 39 constituting the front wall 14 of the container 10. Also, the two lateral precreased areas 59 serve to create two end panels 61 of the frame 22 that are fixed to the inside surface of the rear wall 13 of the container 10 coinciding with the back 17 of the packet 1. In particular, the two panels 60 of the blank 57 are compassed by two edges 62 of Vee profile disposed parallel one with another.

Similarly to the blank 37 used in fashioning the packet, the blank 57 used to fashion the frame 22 as in FIG. 6, and associated with the blank of FIG. 5, exhibits precreased fold areas 58 and 59 consisting in single crease lines 63, whilst the blank 57 of FIG. 8, associated with the blank 37 of FIG. 7, exhibits precreased fold areas 58 and 59 consisting in pairs of crease lines 64.

Finally, the blank 57 of FIG. 10, associated with the blank 37 of FIG. 9, exhibits precreased areas 58 and 59 consisting each in a plurality of crease lines 65.

Figure 14:
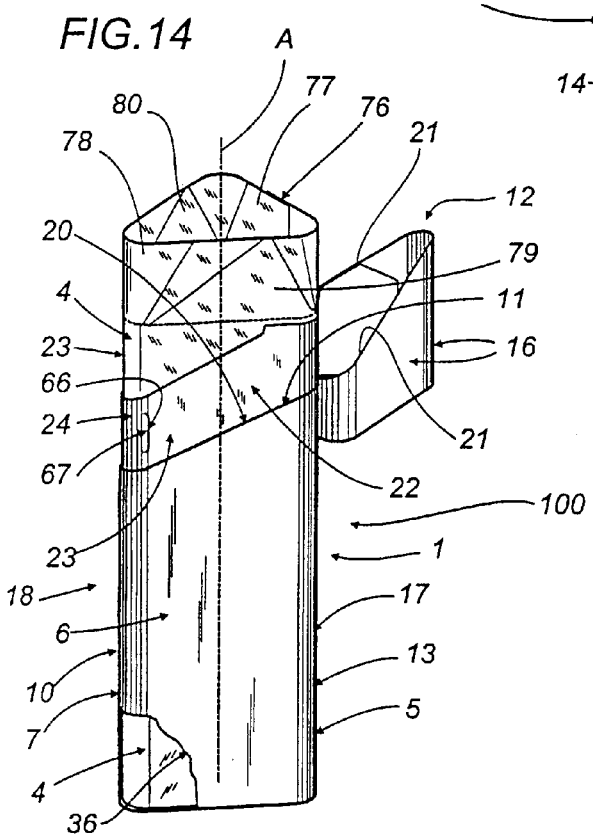
FIGS. 14 to 17 illustrate the packet of FIG. 3 schematically and in perspective and with the lid open, in a succession of steps by which the top end folds of the inner wrapper are made.
Figure 15:
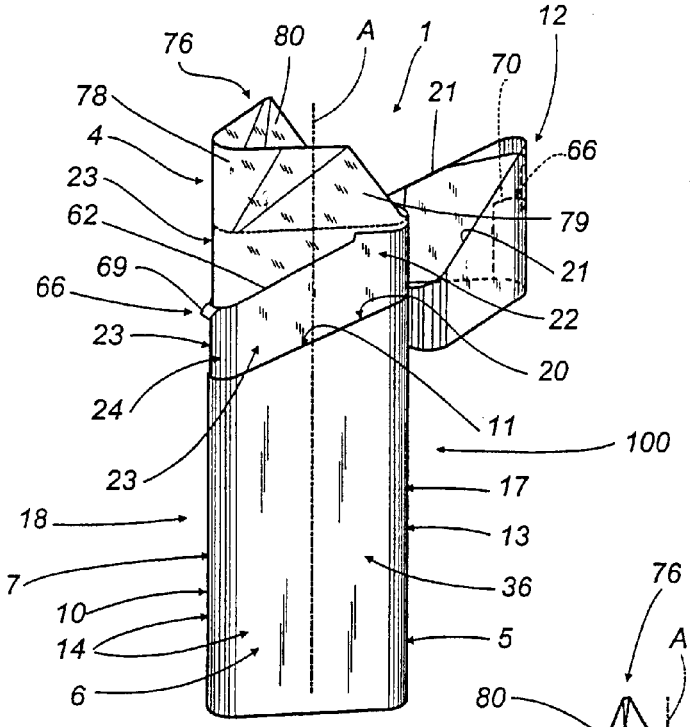
Figure 16:
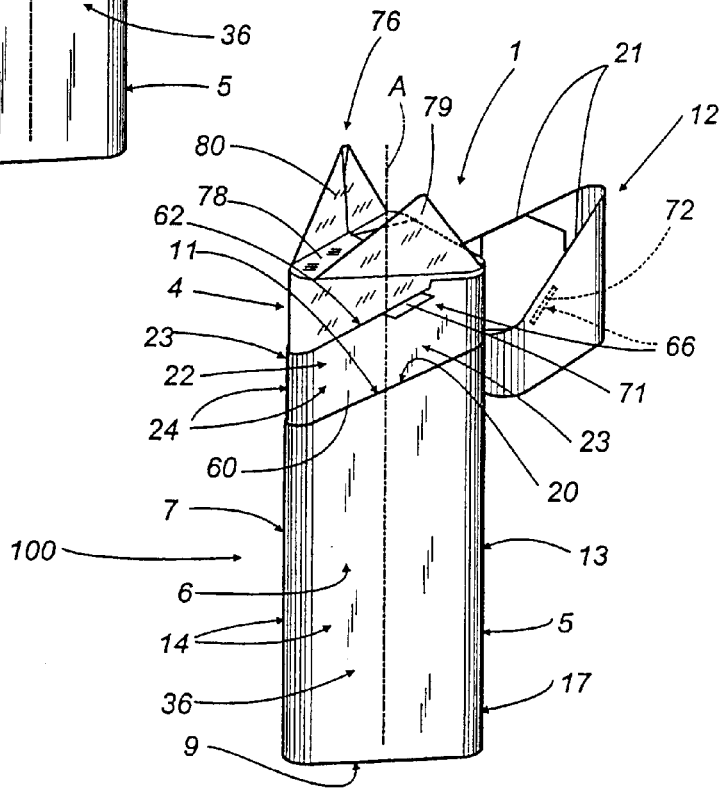
Figure 17:
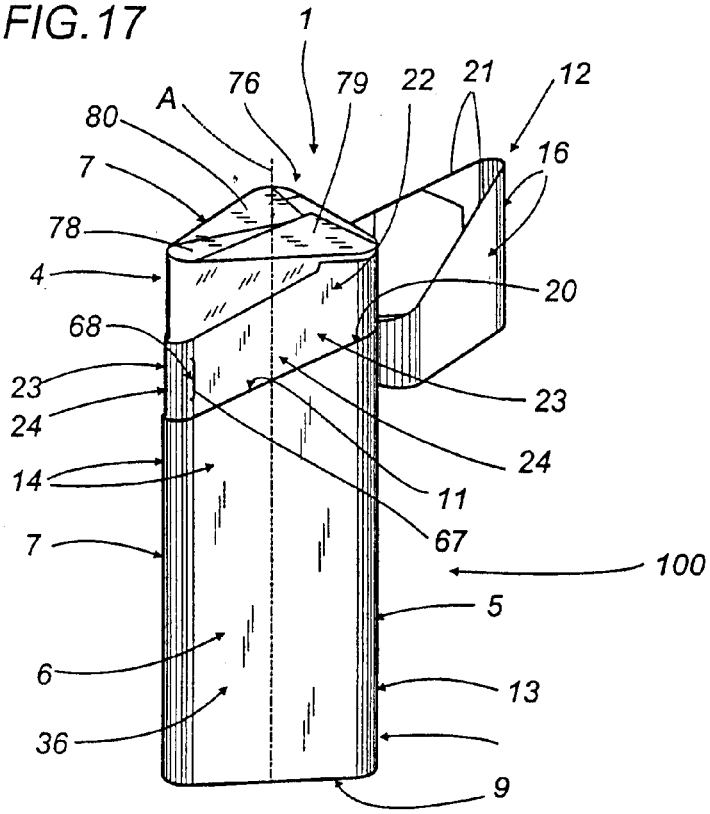

Referring to FIGS. 14, 15 and 16, the packet 1 is furnished with retaining means 66 serving to hold the lid 12 stably in the closed position. In the example of FIG. 14, such retaining means 66 appear as a pair of tabs 67 obtained from relative cuts 68 effected along the central precreased fold area 58 of the blank 57 of material constituting the frame 22, as shown in FIG. 10, and positioned to interfere with the inner surface of the lid 12.

In the example of FIG. 15, retaining means 66 appear as a tab 69 hingedly associated with the edge 62 of the frame 22, placed at the vertex of the Vee, of which the free edge locates in a slot 70 afforded by the inner surface of the lid 12.

In the case of FIG. 16, the retaining means 66 appear as a tab 71 afforded by the frame 22, hinged to the edge 62 of one relative panel 60, of which the free edge locates in a slot 72 afforded by the inner surface of the lid 12.

Figure 11:
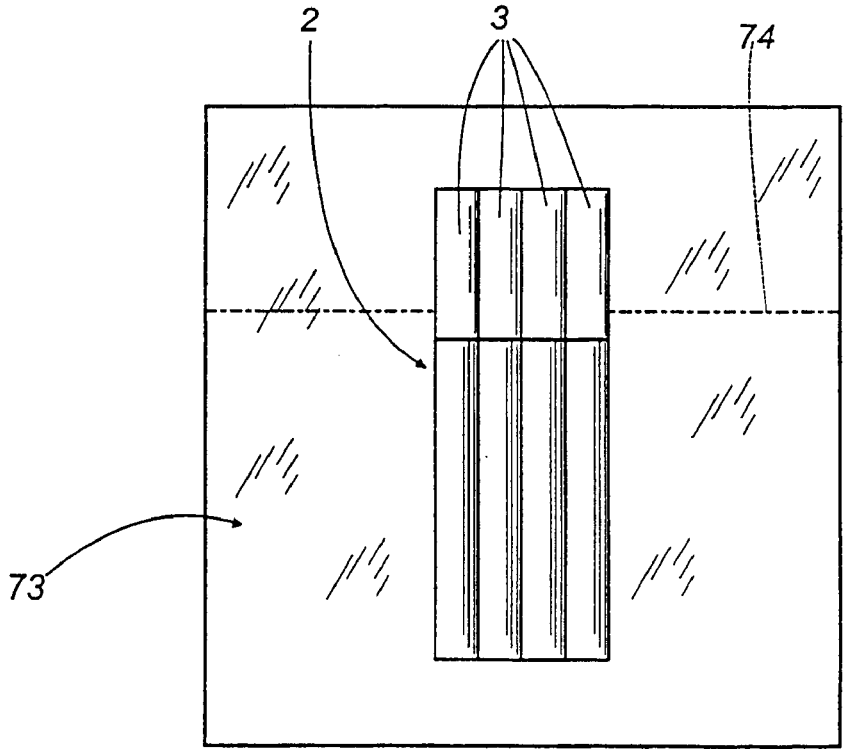
FIG. 11 is the plan view of a leaf of wrapping material from which to fashion the inner wrapper of the packets illustrated in FIGS. 1 to 4.

Referring to FIG. 11, the inner wrapper 4 of the packet is fashioned from a leaf 73 of wrapping material (typically metal foil paper) presenting a transverse line of perforation 74 positioned, as discernible in particular from FIG. 18, in such a way as to delimit a cap 75 that can be removed by the smoker when breaking open the packet 1 and the relative inner wrapper 4.

The leaf 73 is wrapped first into 4 tube around the group 2 of cigarettes 3 whereupon the ends, of which only that coinciding with the top end face 76 of the inner wrapper 4 can be seen in FIGS. 14, 15, 16 and 17, are bent inwards in succession as shown in FIGS. 14 to 17, forming end folds 77, 78, 79 and 80 that are flattened one over another to close the selfsame top end face 76.

Figure 20:
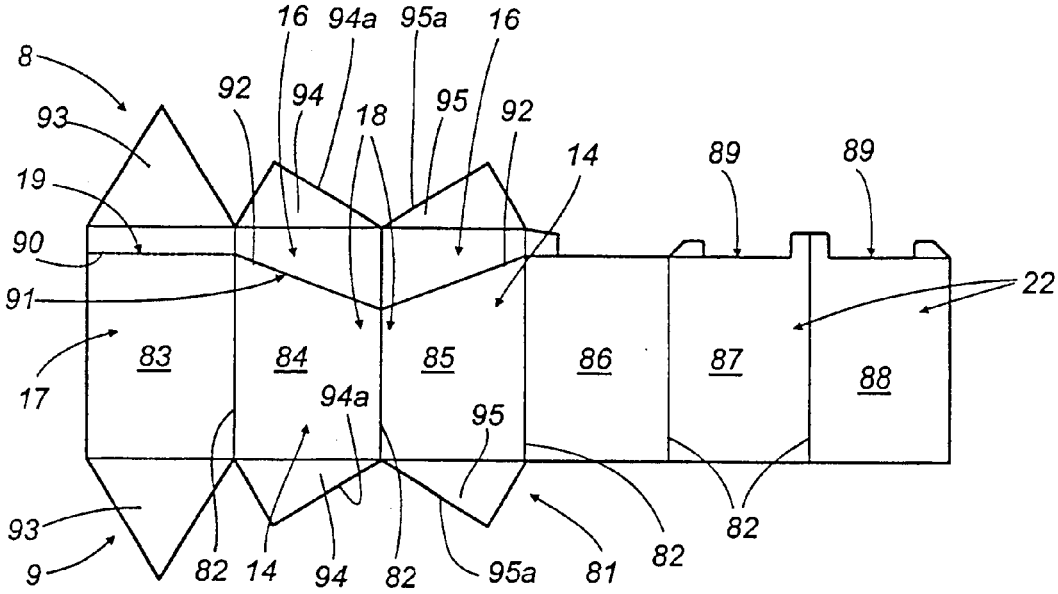
FIG. 20 is a plan view of the diecut blank from which to fashion the packets of FIGS. 1 to 4 and of FIG. 19, illustrated schematically and in an alternative embodiment.

As discernible in FIG. 20, the packet 1 might be erected from a flat diecut blank 81 of wrapping material appearing substantially rectangular in shape and presenting at least five crease lines 82 separating six panels arranged in series.

More exactly, a first end panel 83 coincides with the back 17 of the packet 1, a second panel 84 and a third panel 85 coincide with the front 18 of the packet 1, a fourth panel 86 is a connecting panel, and a fifth panel 87 and a sixth panel 88 will be breasted respectively in contact with the inside surfaces of the second and third panels 84 and 85 in such a way that two respective extremities 89 extending transversely to the crease lines 82 will serve as the stiffening frame 22.

The first panel 83 also presents a transverse crease line 90 coinciding with the hinge 19 and separating the rear wall 13 of the container 10 from the rear wall 15 of the lid 12.

The second and third panels 84 and 85 present a transverse Vee cut 91 that intersects the three corresponding crease lines 82 and is composed, more exactly, of two angled legs 92 converging onto the central crease line 82, by which the front wall 14 of the container 10 on the one hand is separated from the front wall 16 of the lid 12 on the other.

The blank 81 also comprises flaps 93, 94 and 95, hingedly associated along one edge with the first, second and third panels 83, 84 and 85 respectively, one at either end, of which at least the flaps 93 joined to the first panel 83 exhibit an essentially regular triangular outline and coincide with the top 8 and bottom 9 of the packet 1, whereas the flaps 94 and 95 hinged respectively to the second and third panels 84 and 85 exhibit a substantially scalene triangular outline and are disposed in such a way that two adjoining sides denoted 94*a* and 95*a* converge at a predetermined angle.

In the erected packet 1, the two smaller flaps 94 and 95 will be breasted with the inside face of the larger flap 93 without overlapping, being disposed rather with the two adjoining sides 94*a* and 95*a* substantially butted in contact, and combining thus with the corresponding flaps 93 to establish the top 8 and the bottom 9 of the packet 1.

It will be observed that the triangular section of the packet 1 might be equilateral, isosceles or right, and that whichever is selected, the two end faces 8 and 9 at the top and bottom of the packet 1 present the same triangular outline.

It will be observed also that in the example of FIG. 12, which relates to the packet of FIG. 3, the group 2 of cigarettes 3 is four layers deep, whereas in the example of FIG. 13, relating to the packet of FIG. 4, the rounded corner edge 33 between the two front faces 6 and 7 presents a radius of curvature wider than that of the two remaining rounded corner edges 34 and 35, admitting a group of cigarettes 3 only three layers deep.

Figure 21:
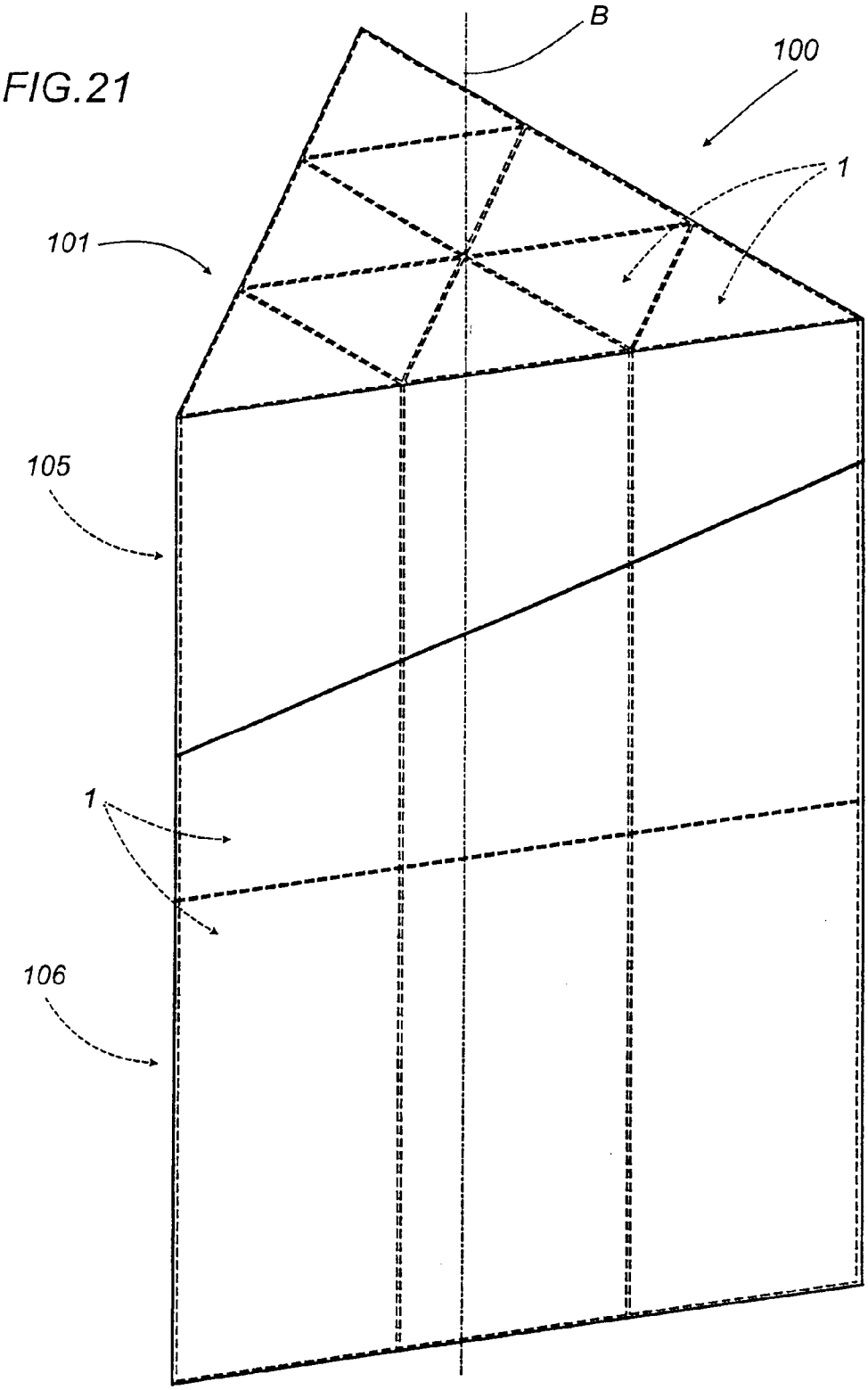
FIGS. 21 to 24 illustrate four embodiments of a carton designed to accommodate the packets shown in FIGS. 1 to 4.

In the example of FIG. 21, the pack 100 appears as a carton 101 of which the external geometry is identical to that of the packet 1 illustrated in FIG. 1, designed to accommodate two groups 105 and 106 of nine packets 1, and in particular the packets of FIG. 1, stacked one on top of another in alignment with the longitudinal axis B of the carton 101.

Figure 22:
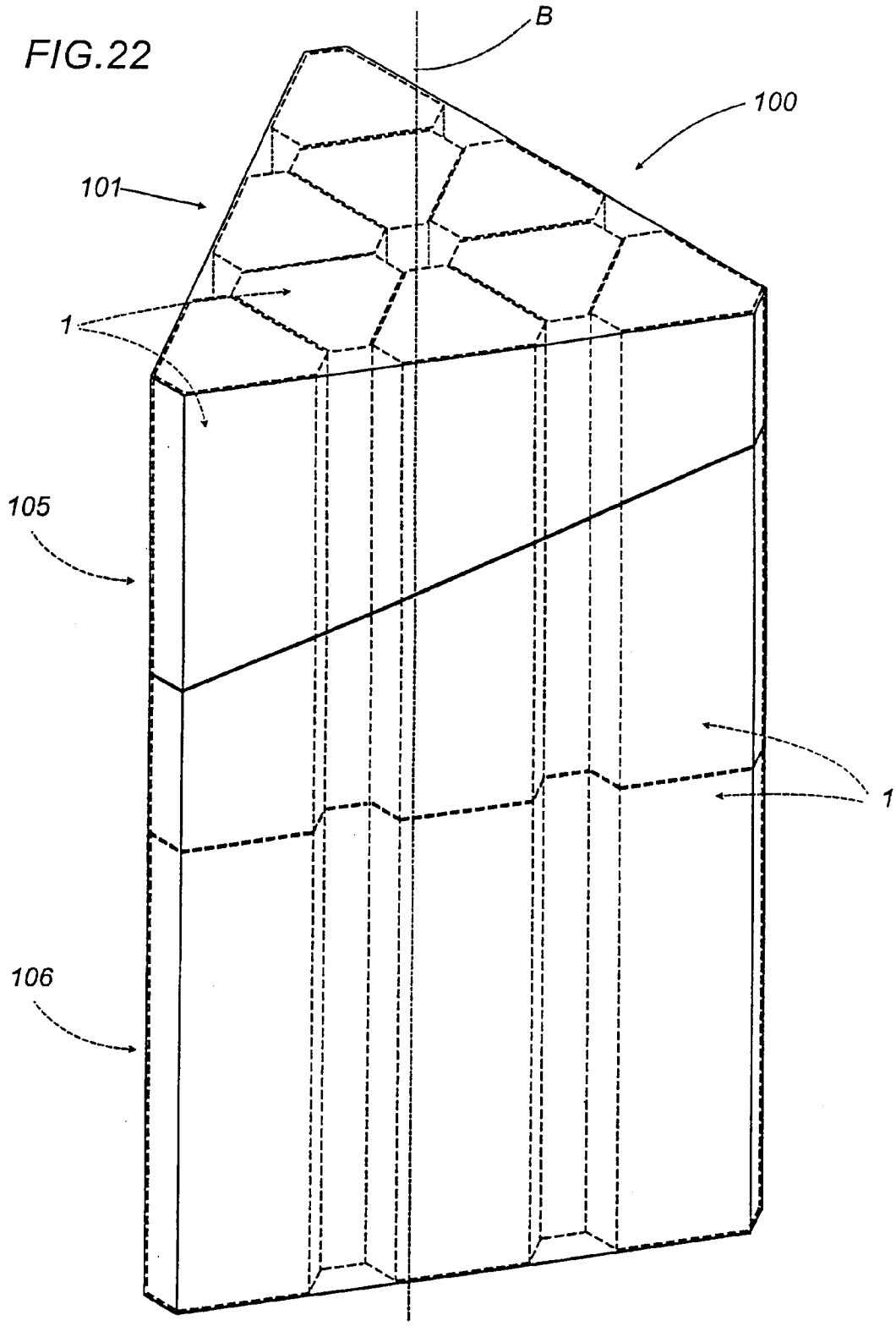

In the example of FIG. 22, the pack 100 appears as a carton 102 of which the external geometry is identical to that of the packet 1 illustrated in FIG. 2, designed to accommodate two groups 105 and 106 of nine packets 1, and in particular the packets of FIG. 2, stacked one on top of another in alignment with the longitudinal axis B of the carton 102.

Figure 23:
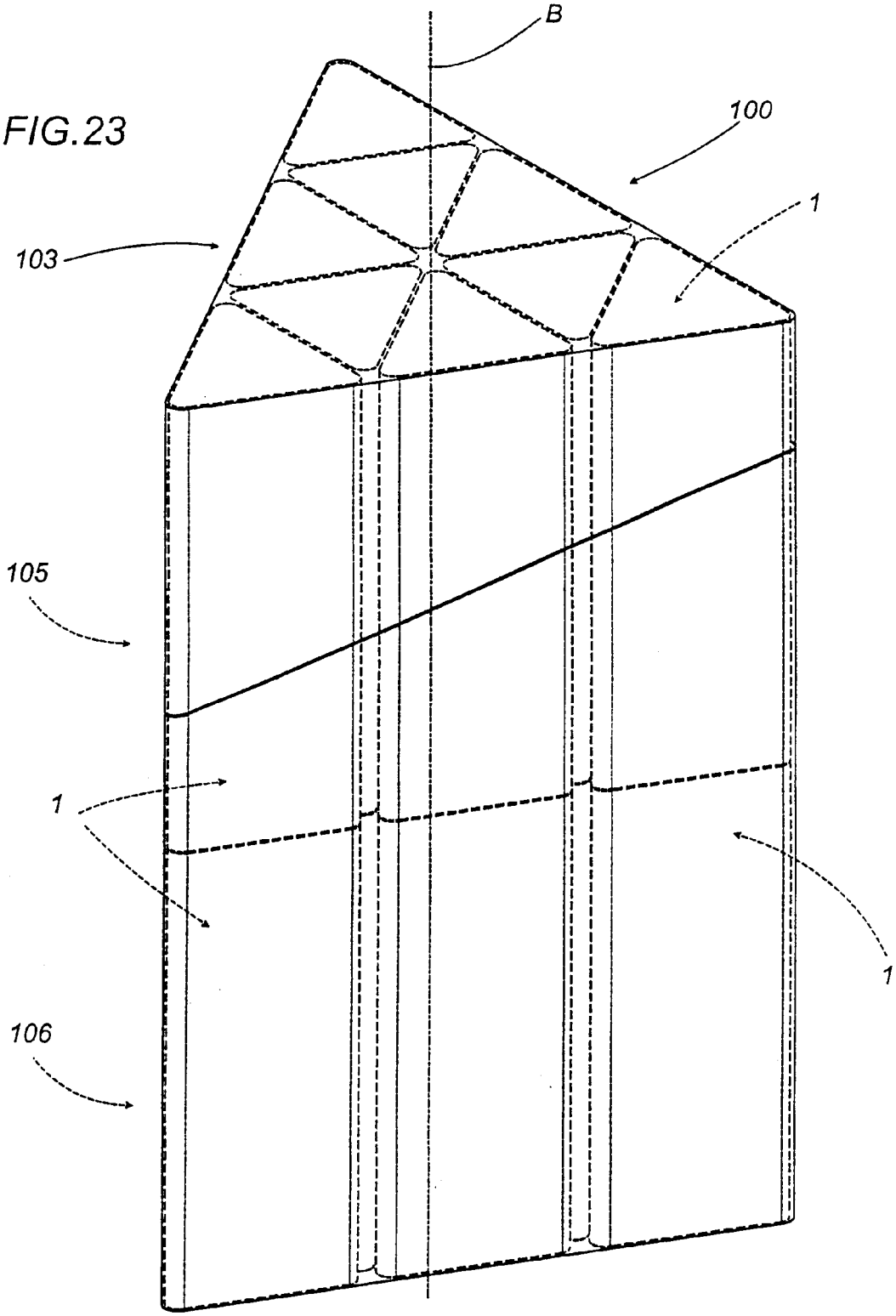

In the example of FIG. 23, the pack 100 appears as a carton 103 of which the external geometry is identical to that of the packet 1 illustrated in FIG. 3, designed to accommodate two groups 105 and 106 of nine packets 1, and in particular the packets of FIG. 3, stacked one on top of another in alignment with the longitudinal axis B of the carton 103.

Figure 24:
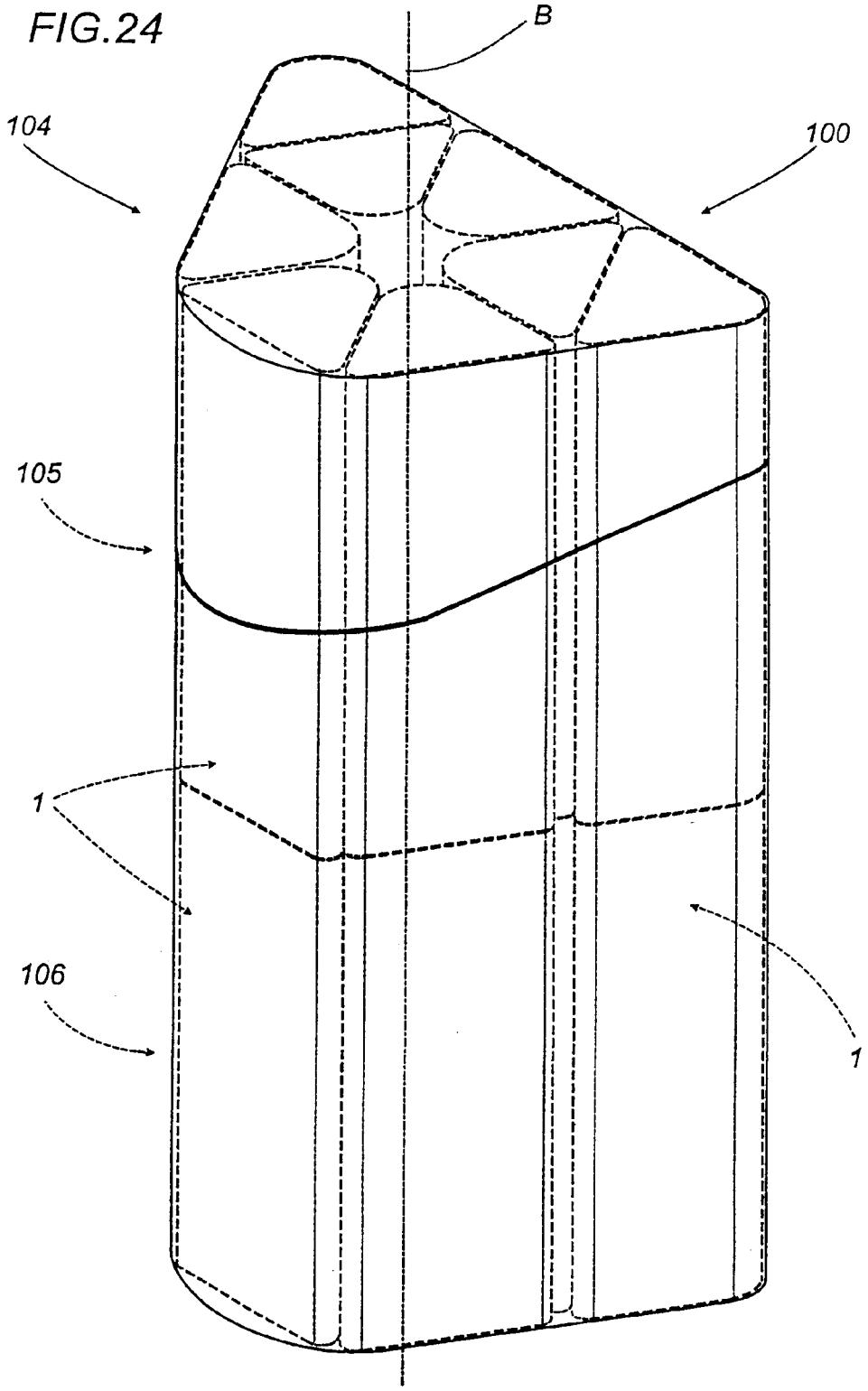

In the example of FIG. 24, the pack 100 appears as a carton 104 of which the external geometry is identical to that of the packet 1 illustrated in FIG. 4, designed to accommodate two groups 105 and 106 of nine packets 1, and in particular the packets of FIG. 4, stacked one on top of another in alignment with the longitudinal axis B of the carton 104.

The cartons 101, 102, 103 and 104 are fashioned from respective diecut blanks as illustrated in FIGS. 5, 7, 8, 9, 10 and 20, and in the manner already described for the packets 1 illustrated in FIGS. 1 to 4.

What is claimed is:

1. A rigid cigarette packet with a hinged lid comprising a container, also a lid hinged to one open end of the container and rotatable between a position in which the container is open and a position in which the container is closed; a group of cigarettes disposed in the container and extending along a predominating longitudinal axis, the group of cigarettes having a substantially triangular cross section; said packet extending as a prismatic solid along the predominating longitudinal axis and having a substantially triangular cross section.

2. A packet as in claim 1, wherein the section is of equilateral triangular outline.

3. A packet as in claim 1, wherein the section is of isosceles triangular outline.

4. A packet as in claim 1, wherein the section is of right triangular outline.

5. A packet as in claim 1, presenting at least one blunted corner edge.

6. A packet as in claim 1, presenting at least one rounded corner edge.

7. A packet as in claim 6, presenting at least two rounded corner edges with dissimilar radii of curvature.

8. A packet as in claim 6, presenting at least one rounded corner edge and two blunted corner edges.

9. A packet as in claim 1, comprising at least one outer wrapper fashioned from a flat diecut blank of wrapping material appearing substantially rectangular in shape and presenting: -three precreased fold areas disposed mutually parallel and delimiting two panels coinciding with the front of the packet, one panel coinciding with the back and one connecting panel;

a transverse Vee cut intersecting the three precreased fold areas and coinciding with the open top end of the container, by which the front wall of the container on the one hand is separated from the front wall of the lid on the other, two crease lines extending one from each end of the Vee cut, disposed transversely to the precreased areas and functioning as a hinge for the lid;

two substantially triangular wings joined along one side to the blank by way of relative crease lines and coinciding respectively with the top and the bottom of the packet.

10. A packet as in claim 9, wherein the wings are furnished with relative sets of flaps extending from the unattached sides of the selfsame wings adjoining the side attached to the blank, the flaps of the one wing combining connectably with two of the panels to fashion the bottom of the erected pack, and the flaps of the other wing combining connectably with the panels constituting the front wall of the lid to fashion the top.

11. A packet as in claim 9, wherein the flaps of the wing coinciding with the top of the packet present a predetermined peripheral outline consisting in a free edge comprising three legs, and are offered to a respective portion of one of the two panels making up the front wall of the lid in such a way as to overlap neither the precreased fold areas nor the Vee cut.

12. A packet as in claim 10, wherein the flaps of the wing coinciding with the bottom of the pack present a predetermined peripheral outline and are offered to a respective portion of one of the panels without overlapping the precreased fold areas.

13. A packet as in claim 9, wherein the precreased fold areas comprise at least one crease line.

14. A packet as in claim 9, wherein the precreased fold areas comprise at least two mutually parallel crease lines set apart one from another by a first predetermined distance.

15. A packet as in claim 9, wherein the precreased fold areas comprise a plurality of mutually parallel crease lines set apart one from another by a second predetermined distance.

16. A packet as in claim 1, comprising a stiffening frame associated with the container and designed to engage the lid when in the closed position, wherein the frame is fashioned from a blank of wrapping material comprising at least one central precreased fold area dividing two panels coinciding with the front of the frame and anchored in part to internal surface of the two panels of the blank coinciding with the front of the packet, in such a way that the frame will project partly from the open top end of the container.

17. A packet as in claim 16, wherein the edge of the frame projecting from the open top end of the container exhibits a Vee profile extending substantially parallel to the open top end of the container defined by the Vee cut of the blank.

18. A packet as in claim 16, wherein the frame comprises two further lateral precreased fold areas disposed parallel with the central precreased fold area, one on either side, and in such a way that the frame can be anchored at least in part to the internal face presented by the panel of the blank coinciding with the back of the pack.

19. A packet as in claim 16, comprising retaining means by which to hold the lid in the closed position, embodied as engagement means operating between the frame and the inner surface of the lid.

20. A packet as in claim 19, wherein engagement means comprise a pair of tabs obtained by making relative cuts along the central precreased fold area of the blank of wrapping material constituting the frame, and positioned to interfere with the inner surface of the lid.

21. A packet as in claim 19, wherein engagement means comprise at least one tab hingedly associated with the edge of one face of the breast piece presented by the frame, of which the free edge locates in a slot afforded by the inner surface of the lid.

22. A packet as in claim 19, wherein engagement means comprise a tab hingedly associated with the edge of the breast piece, presented by the frame at a point coinciding with the central precreased fold area, of which the free edge locates in a slot afforded by the inner surface of the lid.

23. A packet as in claim 1, further comprising an inner wrapper fashioned from a leaf of wrapping material and enveloping a group of cigarettes accommodated inside the packet, presenting a transverse line of perforation serving to delimit a cap that can be removed when breaking open the inner wrapper of the packet.

24. A packet as in claim 1, comprising at least one outer wrapper and a frame associated with the container, by which the lid is engaged when in the closed position, wherein the outer wrapper and the frame are fashioned from a flat diecut blank of wrapping material substantially rectangular in outline, presenting at least five precreased fold areas separating six corresponding panels: a first end panel coinciding with the back of the packet, second and third panels coinciding with the front of the packet, a fourth connecting panel, and fifth and sixth panels positioned to breast respectively in contact with the inside surfaces of the second and third panels in such a way that two respective extremities extending transversely to the precreased areas will function as the frame, of which the first panel presents a transverse crease line coinciding with the hinge of the lid and thus separating the rear wall of the container from the rear wall of the lid, the second and third panels present a transverse Vee cut separating the front wall of the container from the front wall of the lid, and the first, second and third panels are furnished with corresponding flaps hingedly associated along one edge, one at either end, of which at least the flaps joined to one panel exhibit an essentially triangular outline and coincide with the top and the bottom of the packet.

25. A cigarette pack, comprising: a rigid carton with a hinged lid; said pack extending as a prismatic solid along a predominating longitudinal axis; the pack having a substantially triangular cross section, and including a plurality of cigarette packets each having a substantially triangular cross section.

* * * * *